United States Patent [19]

Kawabata et al.

[11] Patent Number: 4,876,479

[45] Date of Patent: Oct. 24, 1989

[54] DEFLECTION YOKE FOR A COLOR CATHODE RAY TUBE

[75] Inventors: Akira Kawabata; Yoshikazu Terasaki; Takashi Inoue; Hidenori Takita, all of Nagaokakyo, Japan

[73] Assignee: Mitsubishi Denki Kabushiki Kaisha, Tokyo, Japan

[21] Appl. No.: 197,952

[22] Filed: May 24, 1988

[30] Foreign Application Priority Data

| | | | |
|---|---|---|---|
| May 25, 1987 | [JP] | Japan | 62-127828 |
| May 27, 1987 | [JP] | Japan | 62-134270 |
| May 28, 1987 | [JP] | Japan | 62-135731 |
| Jul. 7, 1987 | [JP] | Japan | 62-170127 |

[51] Int. Cl.[4] ..... H01F 3/00; H01F 7/06

[52] U.S. Cl. ..... 313/440; 335/213

[58] Field of Search ..... 313/409, 413, 421, 425, 313/428, 433, 437, 439, 440; 335/213, 210, 211

[56] References Cited

U.S. PATENT DOCUMENTS

| | | | |
|---|---|---|---|
| 4,433,268 | 2/1984 | Arisato | 313/440 |
| 4,470,029 | 9/1984 | Chase | 313/421 X |

*Primary Examiner*—Kenneth Wieder

*Attorney, Agent, or Firm*—Birch, Stewart, Kolasch & Birch

[57] ABSTRACT

A deflection yoke for a cathode ray tube comprises a generally tubular core, a first deflection coil assembly including a pair of first deflection coils wound on the core and arranged in symmetrical relationship with each other about the longitudinal axis of the core and operable to deflect electron beams, traveling from an electron gun assembly towards a phosphor-coated screen region, in a horizontal direction, and a second deflection coil assembly generally toroidally wound on the core and operable to deflect the electron beams in a vertical direction. A pair of magnetic members are mounted on the core in opposition to each other and positioned on the imaginary horizontal axis perpendicular to the longitudinal axis of the core while spaced 180° from each other about the longitudinal axis of the core. Each of the magnetic members is constituted by a generally elongated body having a pair of legs protruding from the elongated body which legs are spaced from each other in a vertical direction. A magnetizing member for each magnetic member is also provided for developing predetermined poles in the legs of each of the magnetic members.

23 Claims, 16 Drawing Sheets

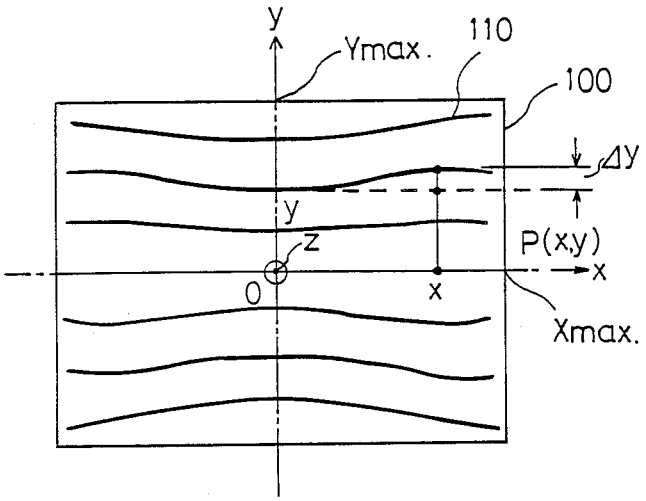
Fig.26
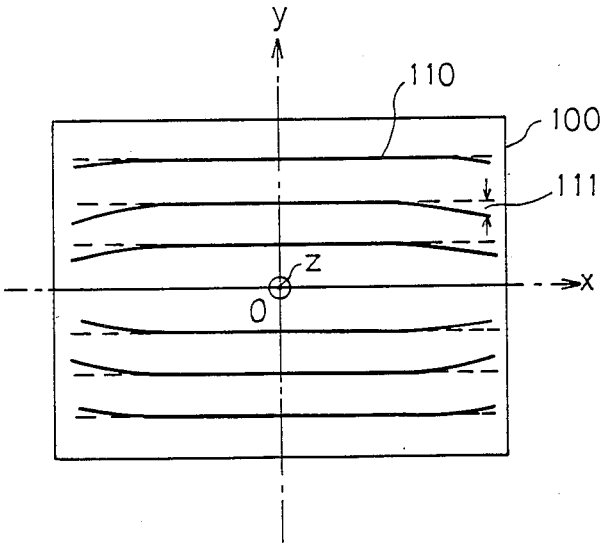

DEFLECTION YOKE FOR A COLOR CATHODE RAY TUBE

BACKGROUND OF THE INVENTION

1. Field of the Invention

The present invention generally relates to a deflection yoke in a cathode ray tube used in a television receiver set and, more particularly, to the deflection yoke of a type mounted on a color cathode ray tube in the vicinity of the funnel and neck sections thereof for deflecting election beams emitted from the electron gun assembly in the cathode ray tube.

2. Description of the Prior Art

Some prior art deflection yokes which appear to be pertinent to the present invention will be discussed with reference to some of the accompanying drawings.

Referring first to FIG. 19 showing, in schematic longitudinal sectional representation, a color cathode ray tube utilizing the prior art deflection yoke, the color cathode ray tube shown therein and generally identified by 50 comprises a highly evacuated envelope including a generally conical funnel section 52, a generally cylindrical neck section 53 protruding from a reduced diameter end of the funnel section 52 and a faceplate 51 provided at a large diameter end of the funnel section 52 opposite the neck section 53. The faceplate 51 has its inner surface deposited with a phosphor coating 55 thereby defining an effective screen region 100 of the faceplate 51, at least a portion of the faceplate 51 where the phosphor coating 55 is deposited being generally concaved so as to protrude outwardly in a direction away from the neck section 53. The cathode ray tube includes an electron gun assembly 54 disposed inside the neck section 53 and a finely perforated shadow mask 56 positioned inside the faceplate 51 and spaced a predetermined distance therefrom so as to extend generally parallel to the faceplate 51. As is well known to those skilled in the art, the shadow mask 56 is made of a metal thin plate having a predetermined pattern of fine apertures 56*a* which are generally triads of minute circular holes and is so curved as to follow the curvature of the faceplate 51. The shadow mask 56 has its peripheral edge secured to a support frame member 57 which is retained in position inside the faceplate 51 by means of a retainer not shown in equally spaced relation to the faceplate 51.

The deflection yoke is generally identified by 1 and is mounted externally on the cathode ray tube 50 at the boundary between the funnel section 52 and the neck section 53.

In the cathode ray tube 50 of the above described construction, electron beams 70 emitted from the electron gun assembly 54 travel towards the faceplate 51 through the perforations 56*a* of the shadow mask 56 and impinge upon the effective screen region 100, that is, the phosphor-coated screen. The electron beams 70 then traveling from the electron gun assembly 54 towards the phosphor-coated screen 100 pass through an electromagnetic field developed inside the cathode ray tube 50 by the deflection yoke 1. During the passage of the electron beams 70 through the electromagnetic field, the electron beams 70 are deflected at a deflection center in the effective electromagnetic field, which effective center is indicated by D, and, after having passed through the fine apertures 56*a* of the shadow mask 56, impinge upon predetermined areas of the phosphor coating 55 thereby to cause such predetermined areas of the phosphor coating 55 to emit light.

The details of the prior art deflection yoke 1 are illustrated in FIG. 20 in perspective representation as viewed from rear, i.e., as viewed from the neck section 53 towards the funnel section 52. As shown, the deflection yoke 1 comprises a generally tubular core 2 made of ferromagnetic material such as, for example, ferrite, a horizontal deflection coil assembly 3 and a vertical deflection coil assembly 4. The horizontal deflection coil assembly 3 comprises a pair of generally saddle-shaped coils wound on the core 2 and arranged in opposite and symmetrical relation to each other with respect to the longitudinal axis of the tubular core 2 and is operable to develop an electromagnetic field necessitated to deflect the electron beams 70 is a horizontal direction. The vertical deflection coil assembly 3 similarly comprises a pair of generally toroidally wound coils on the core 2 and arranged in opposite and symmetrical relation to each other with respect to the longitudinal axis of the tubular core 2 and is operable to develop an electromagnetic field necessitated to deflect the electron beams 70 in a vertical direction perpendicular to the horizontal direction.

In the cathode ray tube of such a construction as hereinbefore described, there is a problematic tendency on the part of the shadow mask 56 to produce a localized buckling or "doming". This doming is a phenomenon in which a localized heating of the shadow mask 56, generally convexed in a direction conforming to the direction of travel of the electron beams 70, takes place as a result of bombardment of the electron beams 70, then traveling towards the phosphor-coated screen region 100. As a result those areas of the shadow mask 56 where heat concentration takes place undergo a thermal expansion to cause those areas of the shadow mask 56 to further protrude outwardly with respect to the direction of travel of the electron beams 70, that is, in a direction close towards the phosphor-coated screen region 100. Once this doming occurs, those areas of the shadow mask 56 displace themselves from their original positions to different positions in which the shadow mask 56 does not effect proper masking of the incoming electron beams 70, and mislanding of the electron beams 70 upon the phosphor-coated screen region 100 takes place resulting in undesirable degradation of color purity.

As one of the countermeasures for eliminating the doming, a bulletin entitled "Terebijon (Television)", Vol. 31, No. 6, pages 46 to 52, describes that the radius of curvature of the shadow mask should be as small as possible.

The curvature of the shadow mask 56 is generally selected in consideration of the curvature of the phosphor-coated screen region 100 on the faceplate 51 and, therefore, the selection of the radius of curvature of the phosphor-coated screen region 100 on the faceplate 51 to a value as small as possible is an effective means for reducing the radius of curvature of the shadow mask 56.

However, the selection of the smaller radius of curvature of the phosphor-coated screen region 100 results in the design of a cathode ray tube in which both of the phosphor-coated screen region 100 and the shadow mask 56 which are generally convexed so as to protrude in a direction towards a television viewer are further protruded towards the television viewer. This design of the cathode ray tube is in contrast to the recent trend in which the faceplate is designed generally flat so as to render a televised picture to be comfortable to view.

In view of the recent trend, a compromise has been made to provide a cathode ray tube having its faceplate rendered to be of non-spherical shape, the faceplate of non-spherical shape being hereinafter referred to as an SP panel.

Hereinafter, features of the SP panel and problems associated with picture distortion peculiar to the cathode ray tube having the SP panel will be discussed.

For the purpose of discussion, FIG. 21 illustrates the generally rectangular phosphor-coated screen region 100 taken as a system of Cartesian coordinates wherein the point of origin 0 lies at the center of the phosphor-coated screen region 100 in alignment with the longitudinal axis of the cathode ray tube 50 while the x-axis extends in a direction parallel to the longer side of the rectangular shape of the phosphor-coated screen region 100, the y-axis extends in a direction parallel to the shorter side of the same and the z-axis extends in a direction in which the phosphor-coated screen region 100 protrudes. The x-axis and y-axis correspond to the horizontal and vertical deflecting direction of the deflection yoke 1 discussed with reference to FIG. 19, respectively.

FIG. 22 illustrates a relative positional relationship between the deflection yoke 1 and the phosphor-coated screen region 100, and FIG. 23 represents a schematic section of one of the halves of the phosphor-coated screen region 100 taken in a plane containing the x-axis and y-axis. Assuming that the section of the phosphor-coated screen region 100 is expressed by $z=f(x)$, the radius of curvature Px when x is an arbitrarily chosen value can be expressed by the following equation:

$$Px=-[1+(df/dx)^2]^{3/2}/(d^2f/dx^2)$$

Thus when the radius of curvature Px takes a positive value, the phosphor-coated screen region 100 protrudes in a direction conforming to the +z-axis.

Assuming that the distance from the point of origin 0 to one extremity of the phosphor-coated screen region 100 in the x-axis direction is expressed by Xmax, it can be said that the SP panel has a portion where the radius of curvature smaller than the radius of curvature PO at $x=0$, which portion is located between locations spaced respective distances $\frac{2}{3}$ Xmax and $\frac{3}{4}$ Xmax away from the point of origin 0 in the plane containing the x-axis and y-axis.

In a cathode ray tube having the above discussed SP panel, the occurrence of the doming can be advantageously minimized without adversely affecting the flatness of the screen as a whole because of the reason stated below.

Specifically, even though the doming takes place considerably at that area of the shadow mask 56 where the angle of deflection is small, that is, which is close to the center ($x=0$) of the phosphor-coated screen region 100, the displacement of that area of the shadow mask 56 brings about small mislanding of the electron beams 70, and therefore brings about less harm, and the flatness in the vicinity of the center of the phosphor-coated screen region 100 is important for the SP panel to be viewed as flat. Therefore, it is desirable for the radius of curvature Po to take a relatively great value.

At the periphery of the phosphor-coated screen region 100 spaced the distance Xmax from the center thereof, since the peripheral edge of the shadow mask 56 is fixed to the support frame member 57, the peripheral portion of the shadow mask 56 is substantially free from thermal deformation resulting from the doming, or if it occurs, the sight of a television viewer is seldom centered on the peripheral portion of the SP panel and, therefore, the television viewer will not be adversely affected. In view of this, the radius of curvature P at $x=Xmax$ may be considered having no weight.

Summarizing the above, it can be concluded that, in order to minimize the occurrence of the doming and the attendant reduction in color purity, the radius of curvature Px at a portion of the phosphor-coated screen region 100 between $x=0$ and $x=Xmax$, particularly between $x=\frac{2}{3}$ and $x=\frac{3}{4}$ Xmax, should be as small as possible as compared with the radius of curvature Po at the center of the phosphor-coated screen region 100. The SP panel is a product developed on the basis of this conclusion.

Another problem associated with distortion of the televised picture being reproduced will now be discussed. When, for example, an image of horizontal parallel lines are reproduced on the screen of the cathode ray tube having the generally spherical phosphor-coated screen region 100, the result would be such as shown in FIG. 24. More specifically, while the horizontal lines 110 forming the image ought to have been reproduced parallel to each other as depicted by the dotted lines in FIG. 24, the horizontal lines 110 actually reproduced are so curved as to diverge away from the x-axis as the distance in the x-axis direction increases away from the center of the phosphor-coated screen region 100. This is because the distance between the deflection point D in the electromagnetic field developed by the deflection yoke 1 and the phosphor-coated screen region 100 shown in FIG. 19 increases with increase of the distance away from the center of the phosphor-coated screen region 100 in the x-axis direction.

Assuming that the magnitude of the divergence of the horizontal lines 110 away from the x-axis with increase of the distance away from the center of the phosphor-coated screen region 100 in the x-axis direction is expressed by $\Delta y$, the magnitude of divergence $\Delta y$ is substantially proportional to $x^2y$ when the point of interest of the phosphor-coated screen region 100 in the system of Cartesian coordinates is (x, y). Since the phosphor-coated screen region 100 is generally spherical in shape, the magnitude of divergence $\Delta y$ can be reduced to a certain extent if the radius of curvature of the phosphor-coated screen region 100 is reduced. Also, the magnitude of divergence $\Delta y$ can also be reduced to a certain extent if the pattern of the electromagnetic field developed by the deflection yoke 1 is suitably tailored.

Although with the combination of the reduced radius of curvature of the screen region 100 and the tailored pattern of the electromagnetic field, complete removal of the above distortion of the horizontal lines 110 is difficult and a small divergence $\Delta y$ remains, the magnitude of remaining divergence $\Delta y$ is still proportional to the value of $x^2y$ or simple function of second order of x and first order of y and, therefore, the addition of a distortion correcting circuit to the deflecting circuit makes it possible to substantially eliminate the distortion.

When it comes to the cathode ray tube having the SP panel, the same horizontal lines 110 will be reproduced on the screen thereof as schematically illustrated in FIG. 25. In the SP panel, since the radius of curvature of the phosphor-coated screen region 100 in a plane containing both of the x-axis and z-axis is such as hereinbefore discussed, the amount of change in distance between the deflection point D and the phosphor-coated screen region 100 differs at respective portions inwardly and outwardly with respect to the location where $x=\frac{2}{3}$ Xmax in the plane containing both of the x-axis and y-axis and, therefore, not only is the magnitude of divergence $\Delta$ y proportional to the value $x^2y$, but also the horizontal lines 110 diverging away from the x-axis tend to suddenly approach the x-axis at a portion outward of $\frac{2}{3}$ Xmax away from the center of the phosphor-coated screen region 100 ($X>\frac{2}{3}$ Xmax).

When viewed in a cross-section of one longer side portion (i.e., at a location of y=Ymax) of the SP panel taken along a plane parallel to the plane containing both of the x-axis and z-axis, as one of the means by which the screen as a whole can be considered flat, it may be contemplated to reduce the width of change of the phosphor-coated screen region 100 in the z-axis direction with the consequence that the bending of the horizontal lines 110 towards the x-axis can be lessened. Where this method is employed, the horizontal lines 110 reproduced on the screen would be such as shown in FIG. 26.

The distortion such as shown in FIG. 26 is referred to as a seagull distortion. The use of a distortion correcting circuit in the deflection circuit appears to be effective to substantially eliminate the occurrence of the seagull distortion. However, the distortion correcting circuit is difficult to design and, if not impossible, would result in the increased manufacturing cost of the cathode ray tube because the magnitude of divergence $\Delta$ y will become a high order function of x ang y.

FIG. 27 illustrates, in a schematic perspective representation, the prior art deflection yoke 1 designed to substantially eliminate the occurrence of the seagull distortion shown in FIG. 26. As shown therein, the deflection yoke 1 of the construction shown in and described with particular reference to FIGS. 19 and 20 is additionally provided with a pair of bipolar magnets 10 spaced 180° from each other about the longitudinal axis of the core 2 and secured to an end flange 8*a* which is fitted to larger diameter end of the core 2 and at a location generally aligned the exit of the electron gun assembly from which the electron beams emerges outwards towards the phosphor-coated screen region. The deflection yoke 1 and FIG. 27 is shown as having a separator 8 mounted on the core 2 in opposition to the end flange 8*b*.

The operation of the cathode ray tube of the construction shown in FIG. 27 will now be described with reference to FIG. 28. By suitably selecting the shape and the dimensions of each of the bipolar magnets 10, mainly horizontally acting components of the magnetic fluxes 11 developed inside the deflection yoke 1 by the bipolar magnets 10 which emanate from one pole to the opposite pole of each of the bipolar magnets 10 while depicting a loop act on the triads of the electron beams 70*a*, 70*b*, 70*c* and 70*d* traveling in four diagonal regions so as to deflect the triads of the electron beams 70*a* to 70*d* in a direction conforming to the y-axis direction and away from the horizontal axis x as indicated by the arrow 11*y*, thereby minimizing the seagull distortion 111 which would appear at any one of the four corner areas of the screen that are spaced from the center of the screen in a direction diagonally thereof.

On the other hand, when vertically acting components of the magnetic fluxes 11 developed inside the deflection yoke 1 by the bipolar magnets 10 are considered the triads of the electron beams 70*e* and 70*f* which are mainly deflected in the horizontal direction are affected by forces 11*x* acting along the x-axis so as to draw the triads of the electron beams 70*e* and 70*f* close towards each other and in a direction towards the center of the screen and, as a result thereof, the triads of the electron beams 70*e* and 70*f* are distorted as shown by 112 in FIG. 29 to represent a generally pincushion distortion with localized protrusions 112*a* inwardly of the center of the screen. Since such a pincushion distortion tends to be enhanced as a quadratic function as the electron beams traveling towards the phosphor-coated screen region approach the bipolar magnets 10, the use of the conventional pincushion correcting circuit in an attempt to compensate for picture distortion at opposite side portions of the screen would result in that a barrel distortion may be induced in the vicinity of the center of the screen. In addition, the use of the conventional pincushion correcting circuit has an additional problem in that it is ineffective to eliminate the distortion such as represented by the localized protrusions 112*a* in FIG. 29.

Since the prior art deflection yoke designed to substantially eliminate the seagull distortion occurring in the cathode ray tube having the SP panel is of the construction such as hereinbefore discussed, the pincushion distortion which is a distortion occurring in the horizontal direction tends to be enhanced while the seagull distortion which is a distortion occurring in the vertical direction is substantially minimized. Moreover, the pincushion distortion so developed is not uniform and is complicated in shape accompanied by localized recesses somewhere in the pincushioned picture being reproduced.

SUMMARY OF THE INVENTION

Therefore, the present invention has been devised with a view to substantially eliminating the above described problems and disadvantages inherent in the prior art and has for its primary object to provide an improved deflection yoke effective to substantially eliminate the seagull distortion which is a distortion occurring in the vertical direction of the cathode ray tube, without bringing any adverse influence on the distortion occurring in the horizontal direction of the cathode ray tube.

Another important object of the present invention is to provide an improved deflection yoke of the type referred to above, wherein the distortion appearing on the curved screen of the SP panel of the cathode ray tube is minimized by a simple means such as, for example, by suitably configuring windings forming the deflection coil assembly.

In order to accomplish the above described objects of the present invention, a deflection yoke herein disclosed comprises a generally tubular core, a first deflection coil assembly including a pair of first deflection coils wound on the core and arranged in symmetrical relationship with each other about the longitudinal axis of the core, said first deflection coil assembly being operable to deflect electron beams, traveling from an electron gun assembly towards a phosphor-coated screen region, in a horizontal direction, and a second deflection coil assembly generally toroidally wound on the core and operable to deflect the electron beams in a vertical direction.

A pair of magnetic members are mounted on the core in opposition to each other and positioned on the imaginary horizontal axis perpendicular to the longitudinal axis of the core while spaced 180° from each other about the longitudinal axis of the core. Each of the magnetic members so mounted on the core is constituted by a generally elongated body having a pair of legs spaced from each other in a vertical direction and protruding from the elongated body. A magnetizing means for each magnetic member is also provided for developing predetermined poles in the legs of each of the magnetic members. The magnetizing means for each magnetic member for developing predetermined poles in the legs of each of the magnetic members, thereby developing a magnetic deflection force to deflect the electron beams traveling towards any one of the four corner areas of the phosphor-coated screen region in a direction away from the horizontal axis while minimizing the magnetic deflection force in the horizontal direction in the vicinity of the horizontal axis.

According to the present invention, magnetic fluxes can be developed in upper and lower areas with respect to the horizontal axis perpendicular to the longitudinal axis of the tubular core, respectively, whereby a upwardly deflecting force and a downwardly deflecting force are developed in the upper and lower diagonal areas for deflecting upwardly and downwardly some of the electron beams traveling in the upper area above the horizontal axis and in the lower area below the horizontal axis, respectively.

On the other hand, each of the magnetic members is, for example, of a generally E-shaped configuration or of a generally U-shaped configuration, no substantial force which would act to deflect some of the electron beams traveling in the vicinity of the horizontal axis in a direction close towards each other in the horizontal direction will be developed.

In view of the foregoing, the present invention is effective to minimize the occurrence of the seagull distortion, which is a distortion occurring in the vertical direction, without the pincushion distortion being accompanied in the horizontal direction.

According to the present invention, furthermore, the second deflection coil assembly generally toroidally wound on the tubular yoke is comprised of a primary winding positioned within an angle of not greater than about 70° with respect to the vertical direction and an auxiliary winding positioned within an angle of about 65° to about 90° with respect to the vertical direction.

The use of the second deflection coil assembly of the construction described above is effective to minimize the occurrence of the seagull distortion. More specifically, when an electric current flows through the primary winding of the second deflection coil assembly which is positioned within an angle of not greater than about 70° with respect to the vertical direction, the resultant magnetic fluxes act on some of the electron beams to deflect the latter in the vertical direction while, when an electric current flows through the auxiliary winding of the same second deflection coil assembly which is positioned within an angle of about 65° to about 90° with respect to the vertical direction, the resultant magnetic fluxes act on some of the electron beams to deflect the latter in a direction substantially diagonally of the screen of the cathode ray tube. The force acting to deflect some of the electron beams in the diagonal direction is intensified as the distance away from the center of the screen in the horizontal direction increases, that is, as the electron beams approach the auxiliary winding of the second deflection coil assembly and, therefore, the seagull distortion can be advantageously substantially suppressed.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined solely by the appended claims. In the drawings, like reference numerals denote like parts in the several views, and:

FIG. 25 is a diagram similar to FIG. 14, showing the distortion occurring in the screen of the color cathode ray tube provided with the SP panel;

FIG. 26 is a diagram showing a seagull distortion occurring the screen after having been corrected by the conventional distortion correcting circuit;

DETAILED DESCRIPTION OF THE EMBODIMENTS

Figure 1:
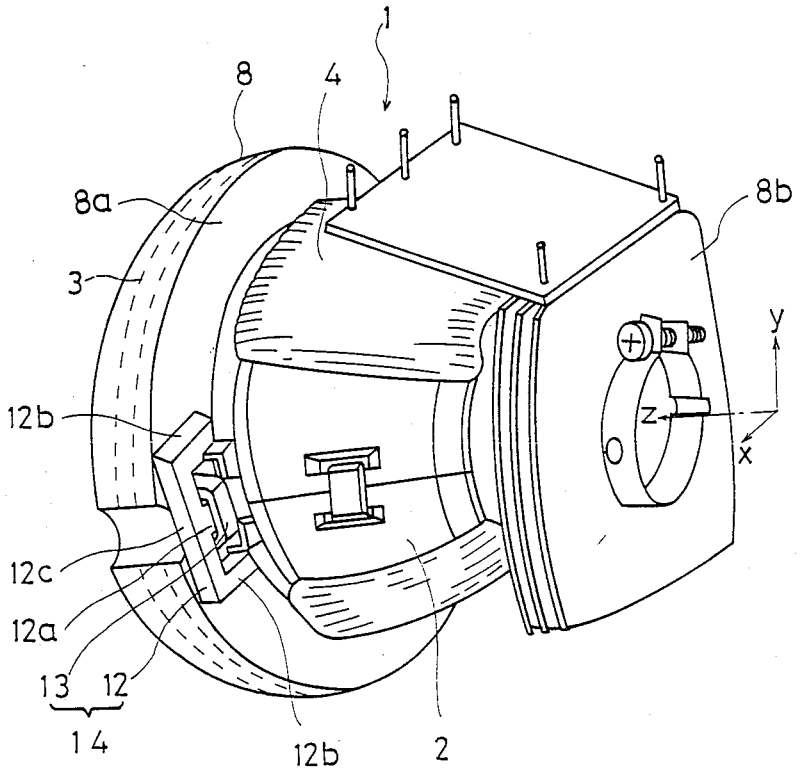
FIG. 1 is a perspective view of a deflection yoke according to one preferred embodiment of the present invention.

Before the description of the present invention proceeds, it should be noted that like parts are designated by like reference numerals throughout the several views of the accompanying drawings.

Referring first to FIG. 1, a deflection yoke 1 embodying the present invention generally comprises a generally tubular core 2 made of ferromagnetic material such as, for example, ferrite, a horizontal deflection coil assembly 3 and a vertical deflection coil assembly 4. The horizontal deflection coil assembly 3 comprises a pair of generally saddle-shaped coils wound on the core 2 and arranged in opposite and symmetrical relation to each other with respect to the longitudinal axis of the tubular core 2 and is operable to develop an electromagnetic field necessitated to deflect the electron beams in a horizontal direction. The vertical deflection coil assembly 3 similarly comprises a pair of coils generally toroidally wound on the core 2 and arranged in opposite and symmetrical relation to each other with respect to the longitudinal axis of the tubular core 2 and is operable to develop an electromagnetic field necessitated to deflect the electron beams in a vertical direction perpendicular to the horizontal direction.

The deflection yoke 1 shown therein also comprises a separator 8 for the support of the horizontal and vertical deflection coil assemblies 3 and 4, which separator 8 includes a front end flange 8*a* adjacent the funnel section of a color cathode ray tube and a rear end flange 8*b* adjacent the neck section of the cathode ray tube.

In accordance with the present invention, the deflection yoke 1 also comprises a magnetic member 12 provided on each side of the tubular core 2 and positioned on the horizontal axis perpendicular to the longitudinal axis of the tubular core 2. The magnetic members 12 positioned on the respective opposite sides of the tubular core 2 are held symmetrical with each other with respect to the longitudinal axis of the tubular core 2. Also, as shown in FIG. 2, each of the magnetic member 12 is comprised of a generally elongated body 12*c* having a pair of legs 12*b*, spaced from each other in the vertical direction and protruding from the respective opposite ends of the elongated body 12*c* in a direction perpendicular to the elongated body 12*c*, and an intermediate leg 12*a* positioned intermediate between the legs 12*b* and protruding in the same direction as any one of the legs 12*b*, all being fabricated to render the respective magnetic members 12 as a whole to represent a generally E-shaped configuration.

These magnetic members 12 are so mounted on the tubular core 2 with their legs 12*a* and 12*b* confronting the tubular core 2 while the legs 12*a* and 12*b* of one of the magnetic members 12 are aligned with the legs 12*a* and 12*b* of the other of the magnetic members 12 in a direction parallel to the horizontal axis perpendicular to the longitudinal axis of the tubular core 2.

Figure 2:
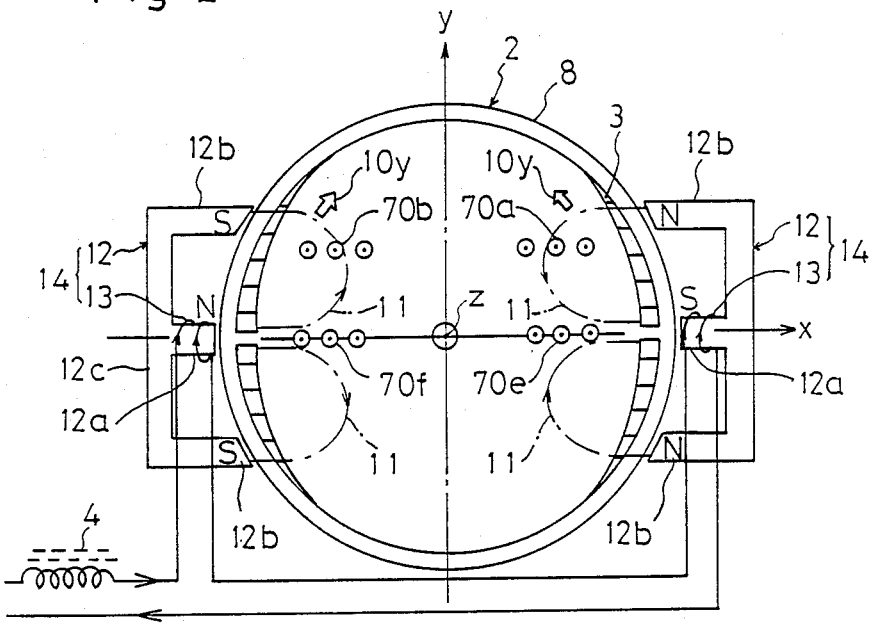
FIGS. 2 and 3 are schematic sectional front views of the deflection yoke of FIG. 1 which are used to explain the operation thereof.

Furthermore, in FIG. 2 the deflection yoke 1 comprises a magnetizing coil 13 provided for each of the magnetic members 12, said magnetizing coil 13 forming one example of a magnetizing means. This magnetizing coil 13 is wound around the intermediate leg 12*a* of each of the magnetic members 12. The magnetic members 12 having the respective magnetizing coils 13 wound around the associated intermediate legs 12*a* altogether constitute respective distortion correcting electromagnets 14 necessitated in accordance with the present invention for the purpose of minimizing the occurrence of the seagull distortion of pictures being reproduced when an electric current is allowed to flow through the magnetizing coils 13 to polarize the legs 12*a* and 12*b* of each of the magnetic members 12 to the predetermined poles, that is, North and South poles.

The deflection yoke 1 of the construction shown in and described with reference to FIG. 1 operates in the following manner.

Figure 3:
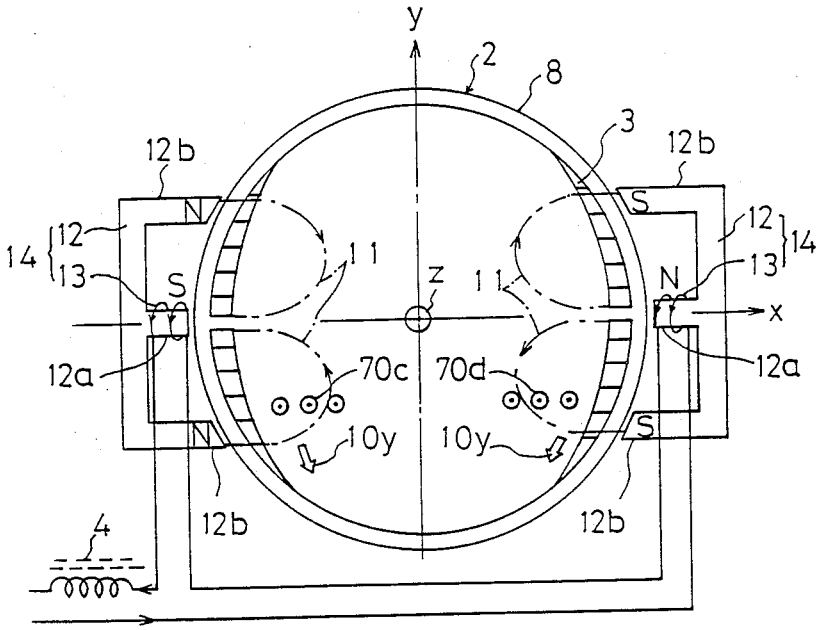

FIG. 2 is a sectional front view of the deflection yoke 1, illustrating how the distortion correcting electromagnets 14 for correcting the distortion work when the electron beams traveling towards the phosphor-coated screen region through the deflecting electromagnetic field are deflected towards a corner area of the screen above the x-axis perpendicular to the longitudinal axis of the cathode ray tube, and FIG. 3 is a similar sectional front view of the deflection yoke 1, illustrating how the same distortion correcting electromagnets 14 work when the electron beams traveling in the deflecting electromagnetic field are deflected towards a corner area of the screen below the x-axis.

Referring to FIG. 2, when a vertical deflecting current of a predetermined polarity as shown is supplied to the magnetizing coils 13, the intermediate leg 12*a* of one of the magnetic members 12, for example, the left-hand magnetic member 12 as viewed in FIG. 2, is polarized to N-pole while the legs 12*b* of the same are polarized to S-pole, the consequence of which is that magnetic lines of force loop from the intermediate leg 12*a* to one of the legs 12*b* and also from the intermediate leg 12*a* to the other of the legs 12*b* as indicated by 11. At the same time, the intermediate leg 12*a* of the right-hand magnetic member 12 is polarized to S-pole while the legs 12*b* of the same are polarized to N-pole, the consequence of which is that magnetic lines of force loop from each of the legs 12*b* to the intermediate leg 12*a* as indicated also by 11.

Figure 4:
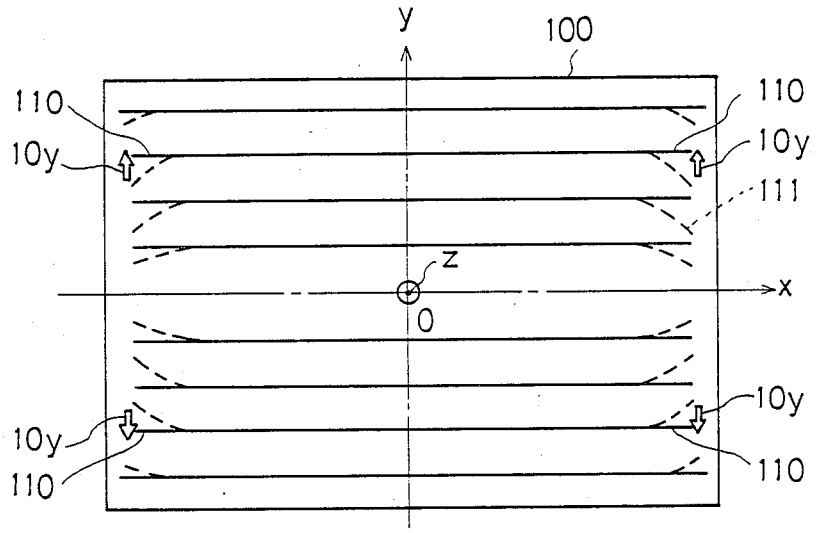
FIGS. 4 and 5 are schematic diagrams showing a raster of a cathode ray tube provided with the deflection yoke according to the present invention, which diagrams are used to explain how distortions are corrected.
Figure 5:
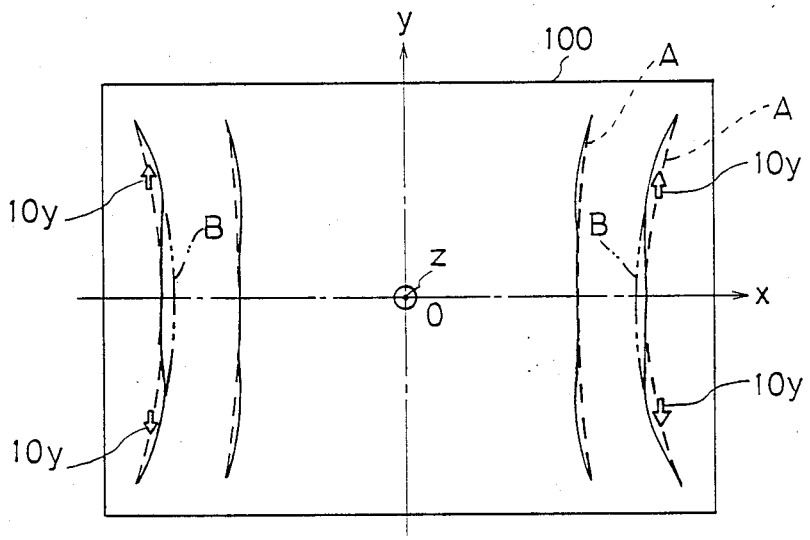

Accordingly, the triads of the electron beams 70*a* and 70*b* deflected towards a corner area of the phosphor-coated screen region spaced a distance of $\frac{2}{3}$ Xmas from the center thereof are affected by an upwardly acting deflection force 10*y* so as to deflect upwardly, that is, in a direction away from the x-axis, whereby lines reproduced on the screen while distorted in the seagull fashion as shown by 111 in FIG. 4 can be corrected to align with the horizontal scanning lines as shown by the solid lines 110 in FIG. 4. Simultaneously therewith, as shown in FIG. 5, pincushion distortion appearing on both sides of the screen as shown by the phantom lines A can also be corrected as shown by the solid lines.

Where the electron beams are deflected towards a corner area of the phosphor-coated screen region below the x-axis, since the looped magnetic lines of force are reversed in polarity by reversed polarity of the vertical deflecting current supplied to the magnetizing coils 13, the triads of the electron beams 70*c* and 70*d* are affected by a downwardly acting deflection force so as to deflect downwardly, thereby lines reproduced on the screen while distorted in the seagull fashion as shown by the phantom lines 111 can be similarly corrected to align with the horizontal scanning lines 110 and the pincushion distortion as shown by the phantom lines 112 in FIG. 5 and appearing on both sides of the screen can also be corrected as shown by the solid lines.

The deflection forces 10*y* vary in synchronism with the position to which the triads of the electron beams are deflected, so that the deflection forces 10*y* may be zero when the triads of the electron beams travel along the x-axis as a result of change in vertical deflecting current, but may increase in proportion to the square of the distance away from the center of the phosphor-coated screen region in both of the x-axis and y-axis directions when the triads of the electron beams are deflected to any one of the four corner areas of the phosphor-coated screen region. Accordingly, without the occurrence of the recesses in the reproduced picture such as shown by 112*a* in FIG. 29, only the seagull distortion 111 in Fig. 4 can be effectively corrected.

Figure 6A:
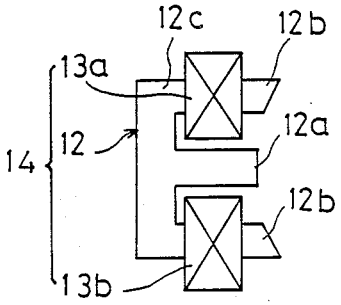
FIGS. 6(*a;b*), 7(*a;b*), 8(*a;b*) and 9(*a–c*) are schematic diagrams showing different modified forms of magnetizing means used in the deflection yoke.
Figure 6B:
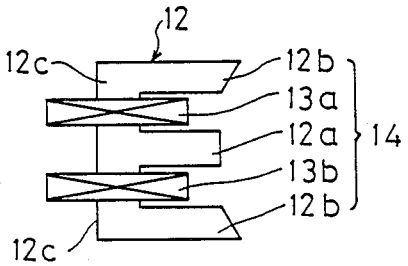
Figure 7A:
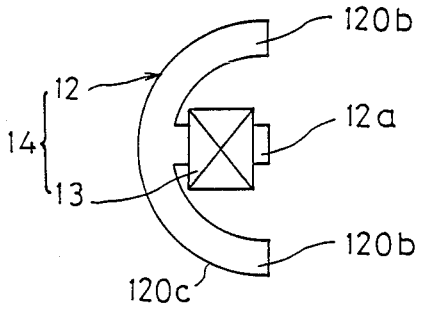
Figure 7B:
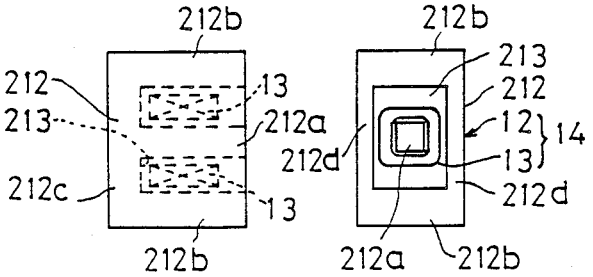
Figure 8A:
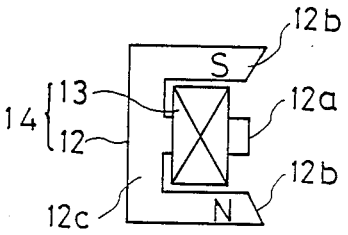
Figure 8B:
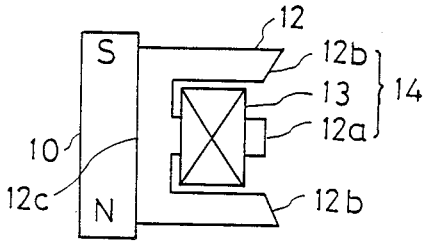

Each of the distortion correcting electromagnets 14 may take various forms such as shown in FIGS. 6 to 8. In the example shown in FIG. 6(*a*), instead of the use of the single magnetizing coil wound on the intermediate leg of each of the magnetic members 12 such as shown in FIGS. 1 to 3, two magnetizing coils 13*a* and 13*b* are used and wound on the respective legs 12*b* of each of the magnetic members 12.

In the example shown in FIG. 6(*b*), the two magnetizing coils 13*a* and 13*b* are wound on respective portions of the elongated body 12*c* of each magnetic member 12 between the intermediate leg 12*a* and one of the legs 12*b* and between the intermediate leg 12*a* and the other of the legs 12*b*, respectively.

In the example shown in FIG. 7(*a*), each of the magnetic members 12 comprises a generally arcuate body 120*c* having its opposite ends 120*b* corresponding in function to the legs 12*b* shown in any one of FIGS. 1 to 3 and 6(*a*) and 6(*b*) and also having the intermediate leg 12*a*, with the magnetizing coil 13 wound on the intermediate leg 12*a*.

In the example shown in FIG. 7(*b*), each of the magnetic members 12 is comprised of a generally rectangular box-like body 212 having a generally rectangular sectioned hollow 213 defined therein so as to leave a pair of end walls 212*b*, a bottom wall 212*c* and a pair of side walls 212*d*, said box-like 212 also having a projection 212*a* protruding from the bottom wall 212*c* into the hollow 213. The magnetizing coil 13 is positioned inside the hollow of the box-like body 212 and wound on the projection 212*a*. In this construction, the end walls 212*b* and the projection 212*a* correspond in function to the legs 12*b* and the intermediate leg 12*a*, respectively, of each of the magnetic members shown in any one of FIGS. 1 to 3 and 6(*a*) and 6(*b*).

In the example shown in FIG. 8(*a*), the legs 12*b* of each of the magnetic members 12 are magnetized to the opposite poles, thereby rendering the magnetic members 12 to be permanent magnets. The magnetic members 12 according to this example of FIG. 8(*a*) are so designed as to exhibit an additional effect similar to that exhibited by the seagull distortion correcting magnets 10 used in the prior art deflection yoke shown in FIG. 27. IN the example shown in FIG. 8(*b*), while each magnetic member 12 is not magnetized, a permanent magnet bar 10 is secured to the elongated body 12*c* of each magnetic member 12.

Figure 27:
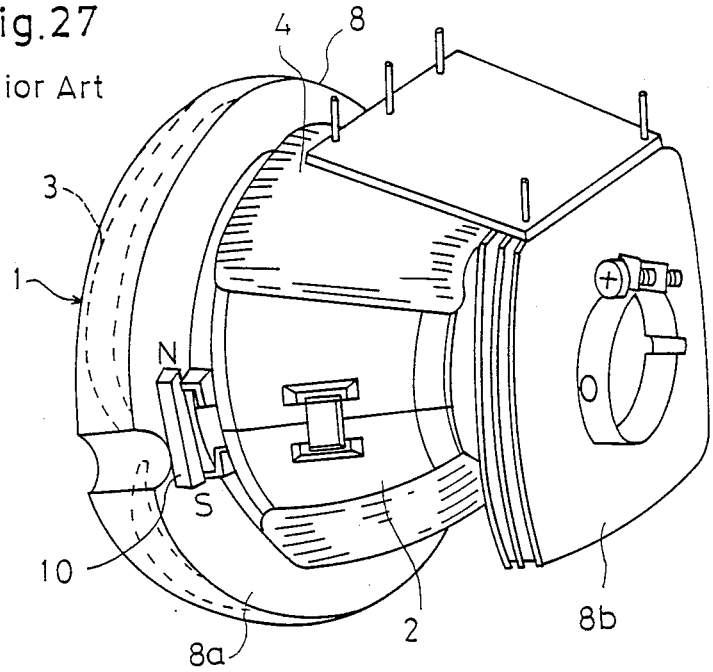
Fig.27 Prior Art
FIG. 27 is a perspective view of the prior art deflection yoke designed to minimize the occurrence of the seagull distortion.

With the use of the electromagnets 14 shown in FIG. 8(*a*) or 8(*b*), the distortion appearing on both sides of the screen, which would result from the use of the permanent magnet in combination with the magnetic members 12, may possibly be a version of pincushion distortion as shown by dotted lines B in FIG. 5 in which the distortion resulting from the use of only the permanent magnet bars 10 such as discussed in connection with the prior art deflection yoke of FIG. 27 is combined with localized pincushion distortion occurring at upper and lower areas of the screen such as shown in FIG. 5.

Such version of pincushion distortion is conventional, curving smoothly from the upper portion down to the lower portion. Therefore, correction of the distortion by the conventional distortion correcting circuit can be easily accomplished.

In the example shown in FIG. 9(*a*), while each of the magnetic members 12 is of the construction shown in and described with reference to FIG. 6(*a*), and electric power supply circuit different from that used with the magnetic member 12 of FIG. 6(*a*) is employed. The electric power supply circuit shown in FIG. 9(*a*) includes diodes 15 and is so designed as to effect the supply of the vertical deflecting current though only one of the magnetizing coils 13*a* and 13*b* thereby to develop the lines of magnetic force only in the area in which the electron beams are deflected while the other of the magnetizing coils 13*a* and 13*b* are held inoperative. More specifically, the coils 13*a* and 13*b* are supplied with only the vertical deflecting current for deflecting the electron beams upwardly with respect to the horizontal axis and with only the vertical deflecting current for deflecting the electron beams downwardly with respect to the horizontal axis, respectively. The coils 13*a* and 13*b* may be wound on the elongated body 12*cx* as shown in FIG. 6(*b*).

Figure 9B:
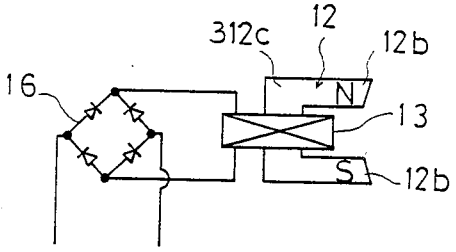
Figure 9A:
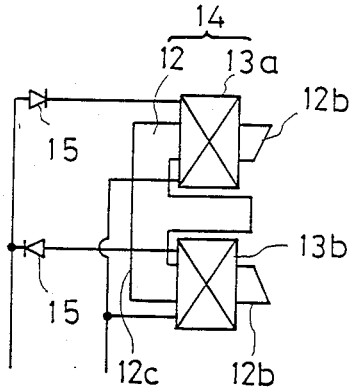
Figure 9C:
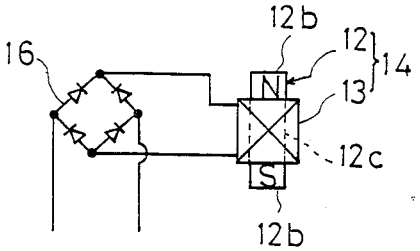

In the example shown in FIG. 9(*b*), each of the magnetic members 12 is comprised of a generally U-shaped body 312*c* having the legs 12*b*, the magnetizing coil 13 being would on the body 312*c* and positioned intermediate between the legs 12*b*. While each magnetic members 12 shown in FIG. 9(*b*) is mounted on the tubular core 2 in a manner similar to that shown in FIG. 2, the magnetizing coil 13 is connected to a source of the vertical deflecting current through a full wave rectifier 16 formed of a diode bridge network.

Figure 28:
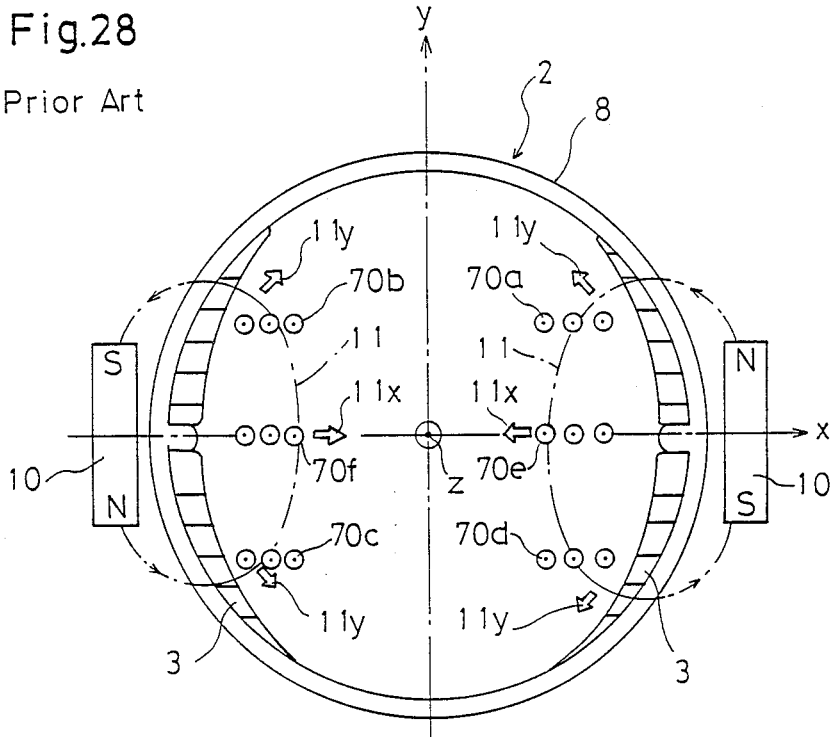
Fig.28 Prior Art
FIG. 28 is a schematic sectional front view of the prior art deflection yoke of FIG. 27, which is used to explain the operation thereof.
Figure 29:
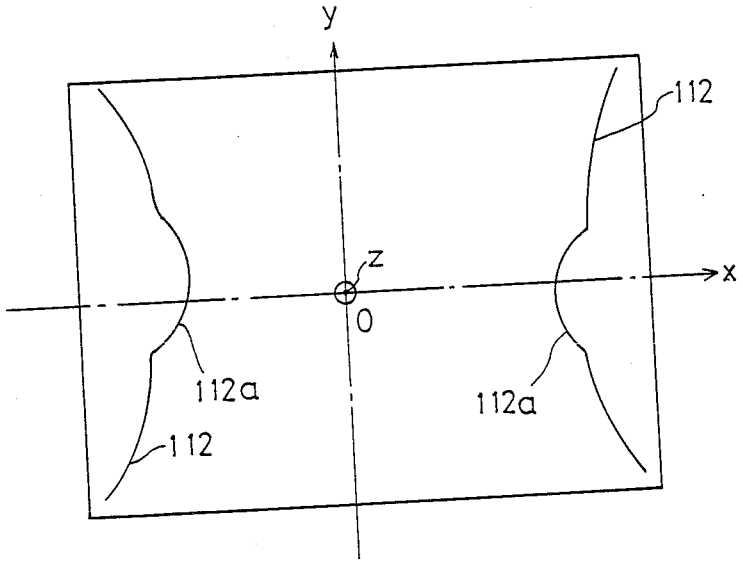
Fig.29 Prior Art
FIG. 29 is a diagram showing the distortion occurring on the screen of the color cathode ray tube provided with the deflection yoke of FIG. 27.

With the magnetic members 12 of the construction shown in FIG. 9(*b*), the magnetic lines of force 11 developed thereby are similar to those developed by the magnets shown in FIG. 28, however, the magnetic lines of force developed by the magnetic members 12 shown in FIG. 9(*b*) will vary with change in vertical deflecting current in such a manner that the magnetic forces can be intensified as the electron beams are deflected upwards or downwards with respect to the x-axis, but will become zero when the electron beams travel along the x-axis. Accordingly, the example of FIG. 9(*b*) is effective to correct the seagull distortion without being substantially accompanied by such a pincushion distortion having the localized recesses as shown in FIG. 29.

In the example shown in FIG. 9(*c*), each magnetic member 12 is comprised of a rod having a substantially intermediate portion or the elongated body 12*c* around which the magnetizing coil 13 is formed. The magnetizing coil 13 is electrically connected with the source of the vertical deflecting current through the full wave rectifier 16 formed of the diode bridge network. The magnetic members 12 of the construction shown in FIG. 9(*c*) can bring about similar effects to those brought about by the magnetic members 12 of the construction shown in and described with reference to FIG. 9(*b*).

Although not shown, each magnetic member of the construction shown in FIG. 9(*b*) may be modified so as to have two magnetizing coils wound around the legs 12*b*.

Some other preferred embodiments of the present invention will now be described with particular reference to FIGS. 10 to 18.

Figure 10:
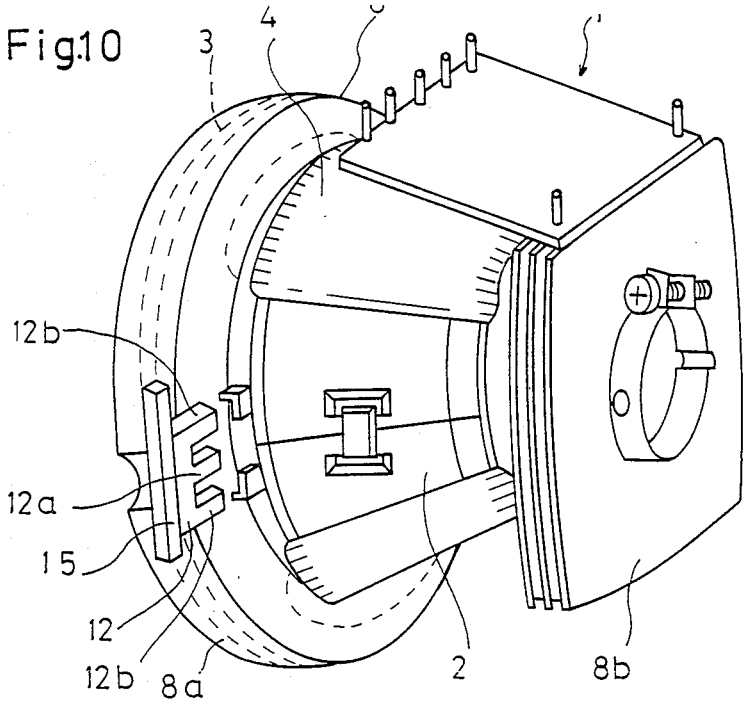
FIG. 10 is a perspective view of the deflection yoke according to another preferred embodiment of the present invention.

Referring first to FIG. 10 showing a second preferred embodiment of the present invention, reference numeral 15 represents a permanent magnet bar secured one side of the elongated body 12*c* of each of the generally E-shaped magnetic members 12 opposite to the legs 12*a* and 12*b*, said permanent magnet bar 15 having a length greater than the elongated body 12*c*. The permanent magnet bars 15 on the respective E-shaped magnetic members 12 are so arranged relative to each other that the N- and S-poles at the opposite ends of one permanent magnet bar 15 confront the S-and N-poles at the opposite ends of the other permanent magnet bar 15, respectively.

The deflection yoke 1 employing the permanent magnet bar 15 for each magnetic member 12 according to this second embodiment of the present invention operates in the following manner.

Figure 11:
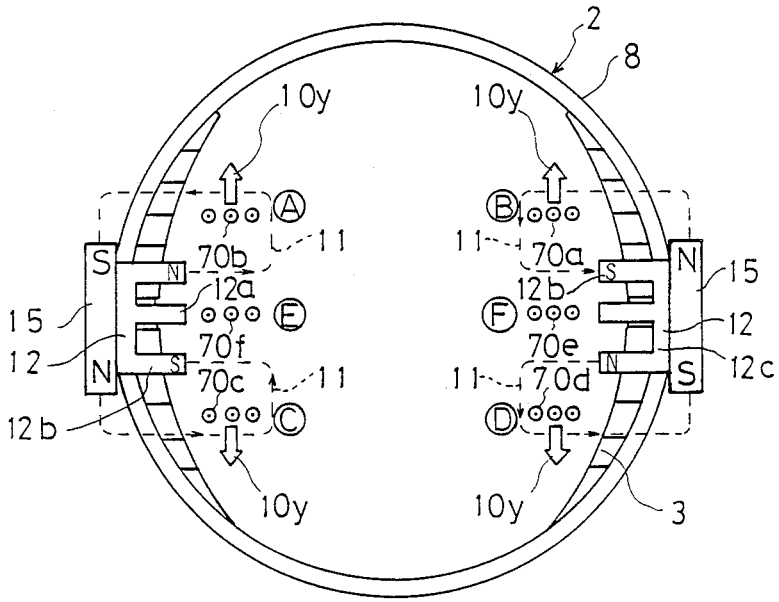
FIG. 11 is a schematic sectional front view of the deflection yoke of FIG. 10 which is used to explain the operation thereof.

FIG. 11 illustrates a sectional front view of the deflection yoke 1 taken along a plane perpendicular to the longitudinal axis of the tubular core 2 at a location where the permanent magnet bars 15 are positioned. As can be understood from FIG. 11, by the combination of the E-shaped magnetic members 12 with the respective permanent magnet bars 15, loops of the magnetic lines of force 11 are developed at respective locations shown by A, B, C and D. By the effect of the loop of the magnetic lines of force 11, the triads of the electron beams 70*b* and 70*a* traveling in the vicinity of the locations A and B, respectively, are affected by the upwardly acting deflecting forces 10*y* to deflect upwards while the triads of the electron beams 70*c* and 70*d* traveling in the vicinity of the locations C and D, respectively, are affected by the downwardly acting deflecting forces 10*y* to deflect downwards, each of said deflecting forces 10*y* increases as a quadratic function with decrease in distance away from the associated magnetic members 12. Therefore, the seagull distortion which would occur when the triads of the electron beams 70*a* to 70*d* are deflected in a direction diagonally with respect to the rectangular phosphor-coated screen region can be advantageously corrected.

On the other hand, the magnetic lines of force at respective locations shown by E and F are very smaller than those at the locations A to D and, accordingly, the force by which the triads of the electron beams 70*e* and 70*f* are affected so as to be deflected towards the x-axis and inwardly of the x-axis can be reduced considerably wherefore the occurrence of both of the pincushion distortion and the localized recesses can be minimized.

Figure 12:
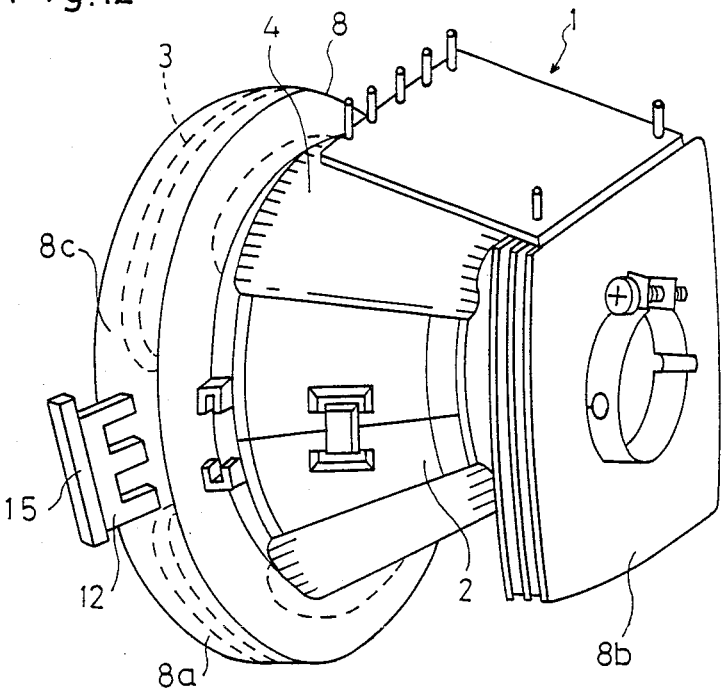
FIG. 12 is a perspective view of a modified form of the deflection yoke shown in FIG. 10.

FIG. 12 illustrates an example in which the E-shaped magnetic members 12 carrying the permanent magnet bars 15 are secured to an outer peripheral face 8*c* of the front end flange 8*a* of the separator 8 adjacent the faceplate of the cathode ray tube, while in FIG. 10 the magnetic members 12 are secured to a rear flange face of the front end flange 8*a*. Even this arrangement makes the resultant deflection yoke 1 to operate in a manner similar, and bring about effects similar, to the arrangement which has been shown in and described with reference to FIG. 10.

Figure 13:
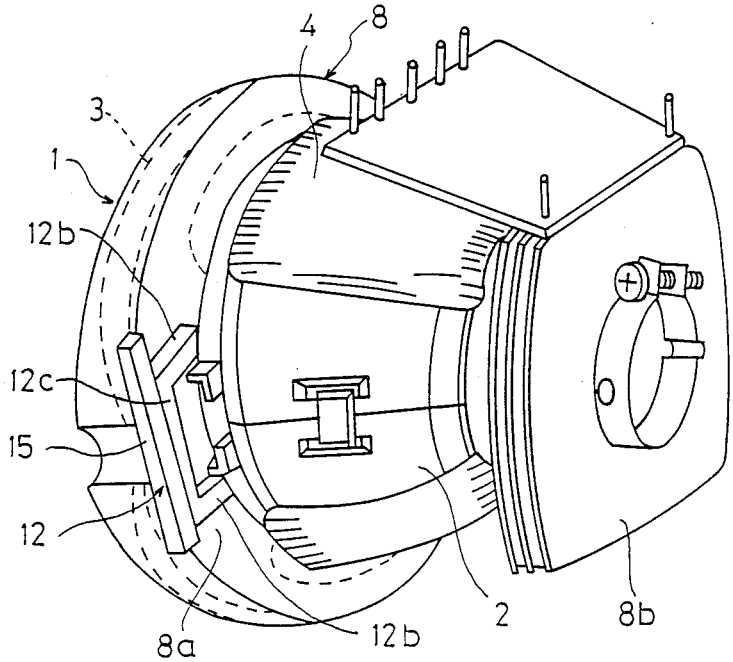
FIG. 13 is a perspective view of the deflection yoke according to a third preferred embodiment of the present invention.

FIG. 13 illustrates, in perspective view, the deflection yoke 1 according to a third preferred embodiment of the present invention. The deflection yoke 1 according to this third embodiment differs from that according to the second embodiment, shown in and described with reference to FIG. 10, in that, instead of the use of the E-shaped magnetic members 12 shown in FIG. 10, each of the magnetic members 12 shown in FIG. 13 is of a generally U-shaped configuration comprising the elongated body 12*c* having only the pair of the legs 12*b*.

Figure 14:
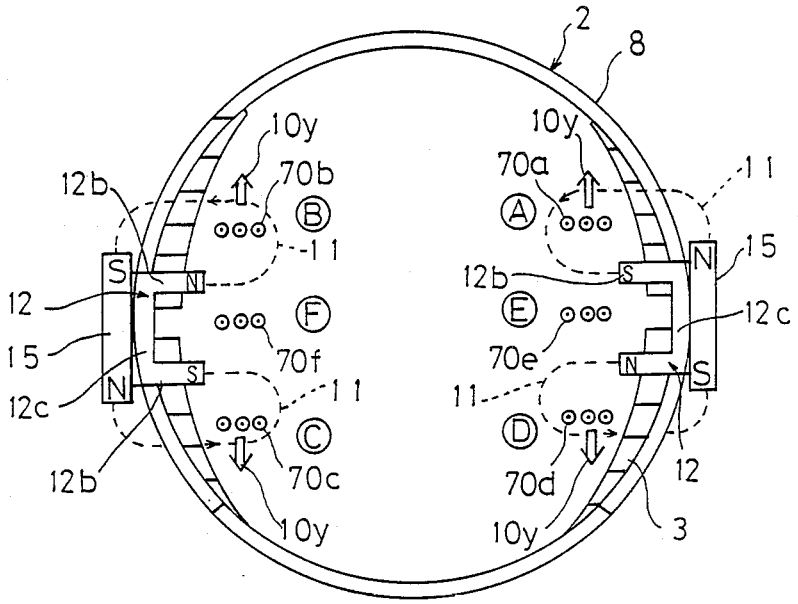
FIG. 14 is a schematic sectional front view of the deflection yoke of FIG. 13, which is used to explain the operation thereof.

The operation of the deflection yoke 1 employing the generally U-shaped magnetic members 12 in combination with the respective permanent magnet bars 15 as shown in FIG. 13 will now be described with reference to FIG. 14 which illustrates a sectional front view of the deflection yoke 1 taken along a plane perpendicular to the longitudinal axis of the tubular core 2 at a location where the U-shaped magnetic members 12 with the respective permanent magnet bars 15 are positioned. As can be understood from FIG. 14, by the combination of the U-shaped magnetic members 12 with the respective permanent magnet bars 15, loops of the magnetic lines of force 11 are developed at respective locations shown by A, B, C and D. By the effect of the loop of the magnetic lines of force 11, the triads of the electron beams 70*a* and 70*b* traveling in the vicinity of the locations A and B, respectively, are affected by the upwardly acting deflecting forces 10*y* to deflect upwards while the triads of the electron beams 70*c* and 70*d* traveling in the vicinity of the locations C and D, respectively, are affected by the downwardly acting deflecting forces 10*y* to deflect downwards. As a result, as is the case with the deflection yoke 1 shown in and described with reference to FIG. 11, the seagull distortion can be advantageously corrected while the occurrence of both of the pincushion distortion and the localized recesses are suppressed.

Figure 15:
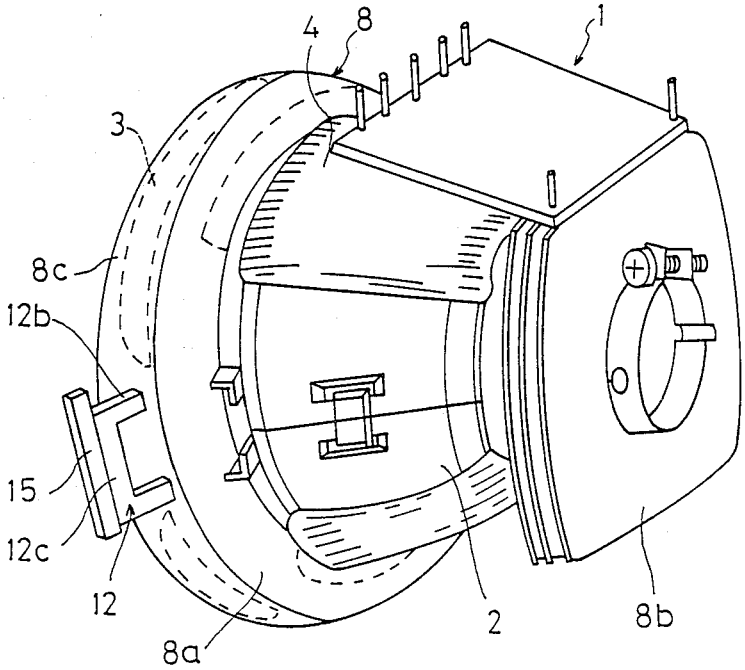
FIG. 15 is a perspective view of a modified form of the deflection yoke shown in FIG. 13.

It is to be noted that, in a manner similar to that shown in FIG. 12, the U-shaped magnetic members 12 carrying the permanent magnet bars 15 may be, as shown in FIG. 15, secured to the outer peripheral face 8*c* of the front end flange 8*a* of the separator 8. Even this arrangement of FIG. 15 makes the resultant deflection yoke 1 to operate in a manner similar, and bring about effects similar, to the arrangement which has been shown in and described with reference to FIG. 13.

It is pointed out that a series of experiment has revealed that, as compared with the use of the U-shaped magnetic members 12 as in the embodiment of FIG. 15, the use of the E-shaped magnetic members 12 as in the embodiment of Fig. 12 is more effective in that the magnetic lines of force in the vicinity of the x-axis (y=0) can be reduced considerably and, therefore, the distortion can be more effectively corrected.

Figure 16:
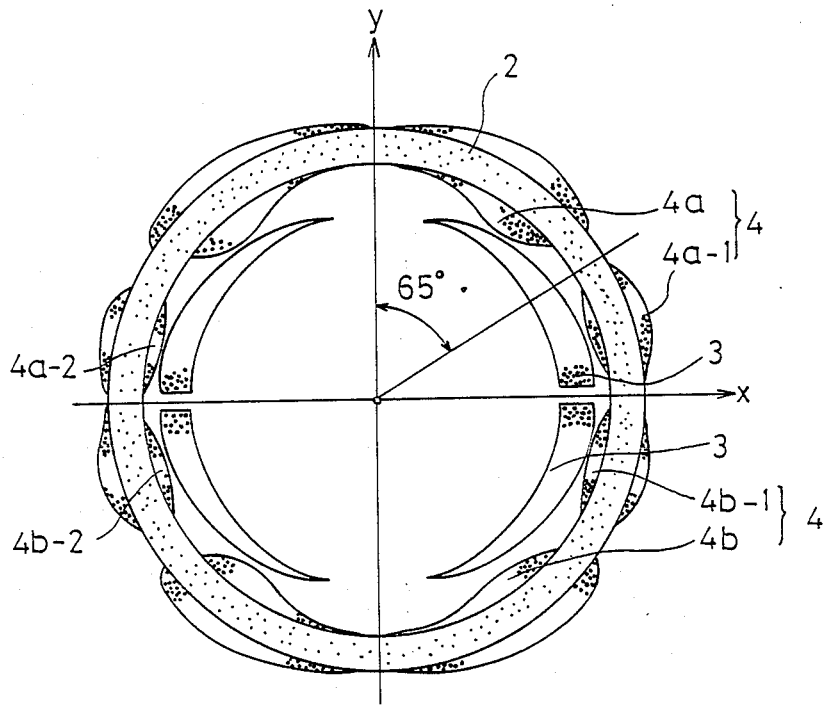
FIG. 16 is a sectional front view of the deflection yoke according to a fourth preferred embodiment of the present invention.

In the embodiment shown in FIG. 16, the deflection yoke 1 shown therein comprises the generally tubular core 2 made of ferromagnetic material such as, for example, ferrite, the horizontal deflection coil assembly 3 and the vertical deflection coil assembly 4. The horizontal deflection coil assembly 3 comprises the pair of the generally saddle-shaped coils wound on the core 2 and arranged in opposite and symmetrical relation to each other with respect to the longitudinal axis of the tubular core 2 and is operable to develop the electromagnetic field necessitated to deflect the electron beams in the horizontal direction. The vertical deflection coil assembly 4 is operable to develop an electromagnetic field necessitated to deflect the electron beams in the vertical direction perpendicular to the horizontal direction.

In accordance with this embodiment of the present invention, the vertical deflection coil assembly 3 comprises a pair of primary coils 4*a* and 4*b* generally toroidally wound on the core 2 and arranged one above the other in opposite and symmetrical relation to each other with respect to the longitudinal axis of the tubular core 2 and two pairs of auxiliary coils 4*a*-1 and 4*a*-2, 4*b*-1 and 4*b*-2, said pairs of the auxiliary coils 4*a*-1 and 4*a*-2, 4*b*-1 and 4*b*-2 being arranged in opposite and symmetrical relation to each other with respect to the horizontal axis or x-axis perpendicular to the longitudinal axis of the tubular core 2 while the auxiliary coils 4*a*-1 and 4*b*-1 and the auxiliary coils 4*a*-2 and 4*b*-2 are positioned on respective sides of the pair of the primary coils 4*a* and 4*b*. The primary coils 4*a* and 4*b* are positioned so as to extend an angle of not greater than about 70° with respect to the y-axis while the pairs of the auxiliary coils 4*a*-1 and 4*a*-2, 4*b*-1 and 4*b*-2 are positioned so as to extend an angle of about 65° to about 90° with respect to the y-axis.

Figure 17:
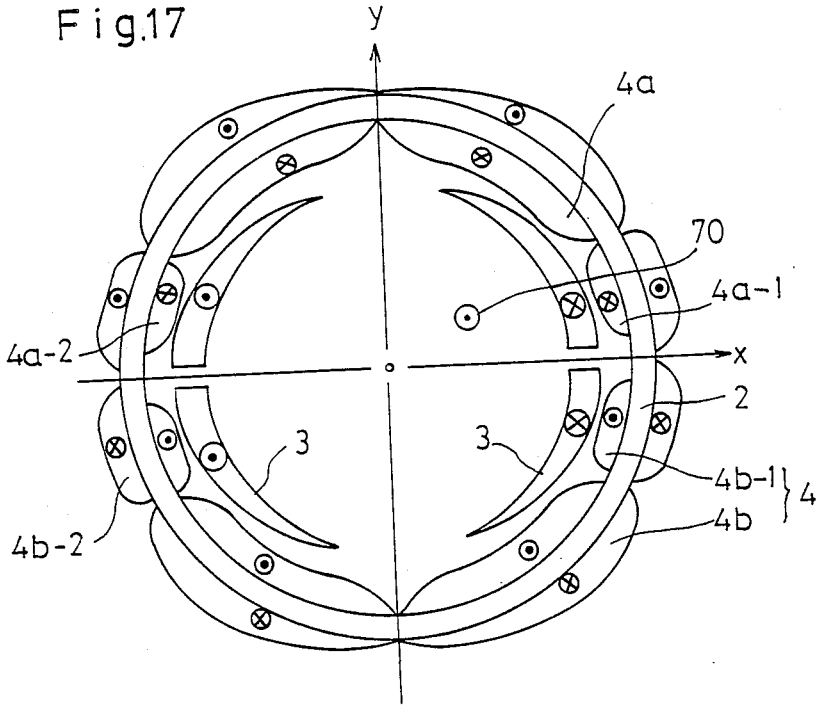
FIG. 17 is a sectional front view of the deflection yoke of FIG. 16, which is used to explain the relationship between the direction of flow of an electric current and the direction of deflection of electron beams.
Figure 18:
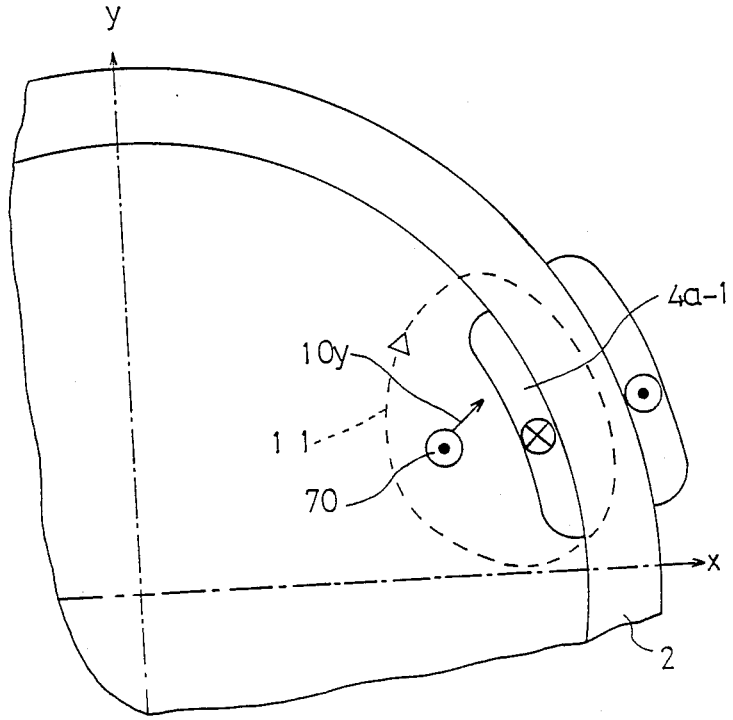
FIG. 18 is a diagram showing, on an enlarged scale, of a portion of FIG. 17.
Figure 19:
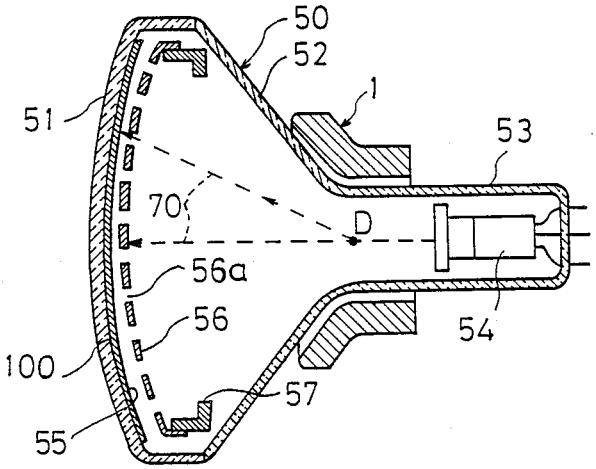
Fig.19 Prior Art
FIG. 19 is a schematic longitudinal sectional view of the color cathode ray tube utilizing the prior art deflection yoke.
Figure 20:
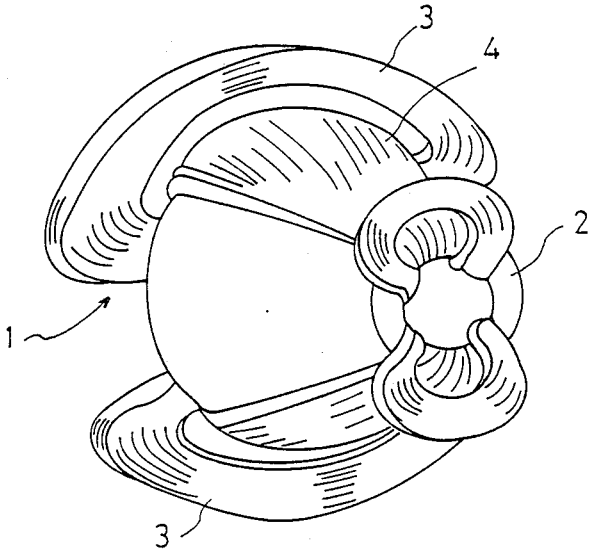
Fig.20 Prior Art
FIG. 20 is a perspective view of the prior art deflection yoke.
Figure 21:
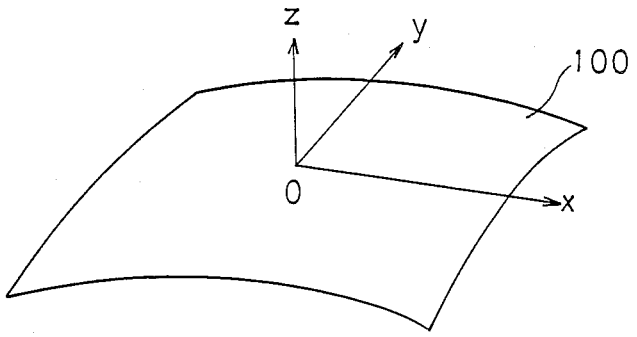
FIG. 21 is a diagram showing the phosphor-coated screen region of the cathode ray tube of FIG. 19 taken as a system of Cartesian coordinates.
Figure 22:
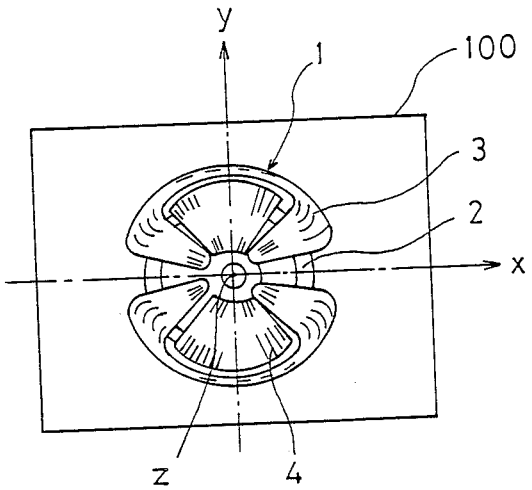
FIG. 22 is a diagram showing the relationship in position between the deflection yoke and the phosphor-coated screen region in the color cathode ray tube.
Figure 23:
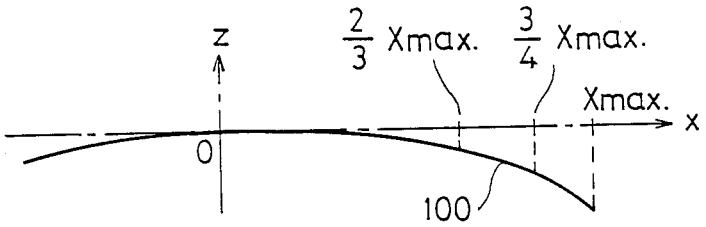
FIG. 23 is a schematic fragmentary sectional view showing the shape of the phosphor-coated screen region of the non-spherical faceplate or SP panel in the color cathode ray tube.
Figure 24:
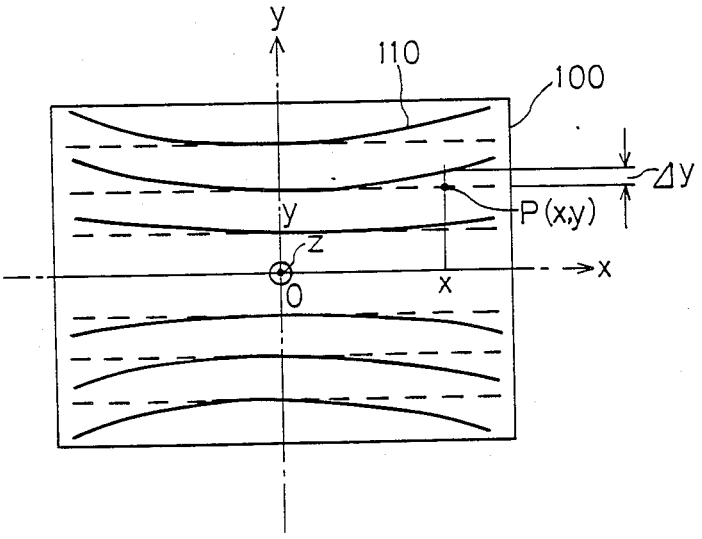
FIG. 24 is a diagram showing the distortion occurring in the screen of the color cathode ray tube provided with the spherical faceplate.

The deflection yoke 1 constructed according to the embodiment shown in FIG. 16 operates in the following manner. FIG. 17 illustrates the direction of flow of an electric current through each of the coils and the direction in which the electron beams are deflected. In FIG. 17, symbols ⊙ and ⊗ represent respective directions in which the electric current through each coil flows, and the direction of the electron beams 70. FIG. 18 illustrates, on an enlarged scale, a portion of the cross-section of the deflection yoke 1 which fails to the first quadrant, i.e., an upper right-hand quadrant, of the system of Cartesian coordinates depicted in FIG. 17 in overlapped relation to the cross-section of the deflection yoke 1 with the longitudinal axis of the tubular core 2 with the point of origin of the Cartesian coordinate system, it being, however, to be noted that the following description made with reference to the first quadrant can equally be applicable to the second to fourth quadrants of the Cartesian coordinate system.

Referring particularly to FIG. 18, when the triads of the electron beams 70 are deflected in a direction diagonally upwardly as viewed in FIG. 18 by the effect of the magnetic lines of force developed by the flow of the electric current through the horizontal deflection coil assembly 3 and also by the flow of the electric current through the primary coils 4*a* of the vertical deflection coil assembly 4, the triads of the electron beams 70 are affected by a rightwardly upwardly acting force 10*y* developed by the magnetic lines of force 11 produced by the flow of the electric current through the auxiliary coil 4*a*-1. This rightwardly upwardly acting force 10*y* is intensified with increase in distance away from the y-axis, that is, as the electron beams 70 approach the auxiliary coil 4*a*-1, and therefore the seagull distortion shown in FIG. 26 can be corrected.

Similarly, in the second, third and fourth quadrants although not shown, the triads of the electron beams are affected by a leftwardly acting force, a leftwardly downwardly acting force and a rightwardly downwardly acting force, respectively, whereby the seagull distortion such as shown in Fig. 26 can be corrected.

It has been found as a result of a series of experiment that the optimum area in which the auxiliary coils 4*a*-1, 4*a*-2, 4*b*-1 and 4*b*-2 are positioned is the area about 70° about the y-axis for maximizing the distortion correcting effect. It has also been found as a result of a series of experiment that the optimum area in which the primary coils 4*a* and 4*b* are positioned is the area extending from 0° to about 60° on each side with respect to y-axis for accomplishing the predetermined vertical deflection of the electron beams and, accordingly, in FIGS. 16 and 17, the angle of about 60° is shown on each side with respect to the y-axis. However, the area to which the primary coils 4*a* and 4*b* are positioned can be extended to 70°, and the area preferable to avoid overlapping with the auxiliary coils is decreased to the area extending from 0° to about 65°.

It is also to be noted that, if the primary coils 4*a* and 4*b* are so positioned as to partially overlap with the auxiliary coils 4*a*-1, 4*a*-2, 4*b*-1 and 4*b*-2, the deflecting effect exhibited by the primary coils and that exhibited by the auxiliary coils will interfere with each other. Accordingly, the positioning of the primary coils in partially overlapping relationship with the auxiliary coils is preferred to be avoided.

Although the present invention has fully been described in connection with the preferred embodiments thereof with reference to the accompanying drawings used only for the purpose of illustration, those skilled in the art will readily conceive numerous changes and modifications within the framework of obviousness upon the reading of the specification herein presented of the present invention. Accordingly, such changes and modifications are, unless they depart from the spirit and scope of the present invention as delivered from the claims annexed hereto, to be construed as included therein.

We claim:

1. A deflection yoke for a cathode ray tube having a funnel section and a neck section, said deflection yoke being mounted on the cathode ray tube at a location corresponding to the boundary between the funnel and neck sections, which deflection yoke comprises:

a generally tubular core;

a first deflection coil assembly including a pair of first deflection coils wound on the core and arranged in symmetrical relationship with each other with respect to the longitudinal axis of the core, said first deflection coil assembly being operable to deflect electron beams, traveling from an electron gun assembly towards a phosphor-coated screen region in a horizontal direction;

a second deflection coil assembly generally toroidally wound on the core and operable to deflect the electron beams in a vertical direction;

a pair of magnetic members mounted on the core in opposition to each other and positioned on a horizontal axis perpendicular to the longitudinal axis of the core while spaced 180° from each other about the longitudinal axis of the core, each of said magnetic members being constituted by a generally elongated body having at least two legs, said two legs being spaced from each other in a vertical direction and protruding from the elongated body; and a magnetizing means for each magnetic member for developing predetermined poles in the legs of each of the magnetic members, thereby developing a magnetic deflection force to deflect the electron beams deflected by the first and second deflection coil assembly and traveling towards any one of the four corner areas of the phosphor-coated screen region in a direction away from the horizontal axis while minimizing the magnetic deflection force in the horizontal direction in the vicinity of the horizontal axis.

2. The deflection yoke as claimed in claim 1, wherein the legs of one of the magnetic members are opposite in polarity to the legs of the other of the magnetic members which are aligned with the legs of said one of the magnetic members.

3. The deflection yoke as claimed in claim 2, wherein the legs of each of the magnetic members are protruding from the elongated body.

4. The deflection yoke as claimed in claim 3, wherein said elongated body also has an intermediate leg positioned between said legs and protruding in the same direction in which said legs protrude, whereby each of the magnetic members represents a generally E-shaped configuration.

5. The deflection yoke as claimed in claim 4, wherein said magnetizing means comprises a coil to polarize each of the magnetic members.

6. The deflection yoke as claimed in claim 5, wherein said legs are polarized to one pole and said intermediate leg is polarized to the other pole.

7. The deflection yoke as claimed in claim 5, wherein said coil is supplied with a vertical deflecting current.

8. The deflection yoke as claimed in claim 5, wherein said legs are magnetized to respective poles opposite to each other to render each of the magnetic members to be a permanent magnet.

9. The deflection yoke as claimed in claim 5, wherein said coil is wound on said intermediate leg.

10. The deflection yoke as claimed in claim 4, wherein said magnetizing means comprises a pair of coils wound on said respective legs.

11. The deflection yoke as claimed in claim 4, wherein said magnetizing means comprises a pair of coils wound on respective portions of the elongated body between the intermediate leg and one of the legs and between the intermediate leg and the other of the legs.

12. The deflection yoke as claimed in claim 4, wherein said magnetizing means comprises a pair of coils, one of said coils being wound on the upper leg or a portion of the elongated body between the upper leg and the intermediate leg and the other of said coils being wound on the lower leg or a portion of the elongated body between the lower leg and the intermediate leg, said one of the coils being supplied with a vertical deflecting current for deflecting the electron beams upwardly with respect to the horizontal axis, said other of the coils being supplied with a vertical deflecting current for deflecting the electron beams downwardly with respect to the horizontal axis.

13. The deflection yoke as claimed in claim 3, wherein said elongated body having the legs represents a generally U-shaped configuration.

14. The deflection yoke as claimed in claim 13, wherein said magnetizing means comprises a coil to polarize each of the magnetic members.

15. The deflection yoke as claimed in claim 14, wherein said coil is supplied with a vertical deflecting current through a full wave rectifier.

16. The deflection yoke as claimed in claim 14, wherein said coil is wound on the elongated body and positioned between the legs.

17. The deflection yoke as claimed in claim 13, wherein said magnetizing means comprises a pair of coils wound on said respective legs.

18. The deflection yoke as claimed in claim 2, wherein each of said magnetic members is of a rod-shaped configuration extending in the vertical direction and wherein the magnetizing means comprises a coil would on the elongated body to polarize each of the magnetic members, said coil being supplied with a vertical deflecting current through a full wave rectifier.

19. The deflection yoke as claimed in claim 3, wherein each magnetizing means includes a magnet bar having a length greater than the length of the elongated body.

20. The deflection yoke as claimed in claim 19, wherein the magnet bar in one of the magnetizing means has opposite pole ends positioned opposite in polarity to the opposite pole ends of the magnet bar in the other of the magnetizing means.

21. A deflection yoke for a cathode ray tube having a funnel section and a neck section, said deflection yoke being mounted on the cathode ray tube at a location corresponding to the boundary between the funnel and neck sections, which deflection yoke comprises:

a generally tubular core;

a first deflection coil assembly including a pair of first deflection coils wound on the core and arranged in symmetrical relationship with each other with respect to the longitudinal axis of the core, said first deflection coil assembly being operable to deflect electron beams, traveling from an electron gun assembly towards a phosphor-coated screen region in a horizontal direction; and a second deflection coil assembly generally toroidally wound on the core and operable to deflect the electron beams in a vertical direction, said second deflection coil assembly including a primary winding means positioned so as to extend an angle of not greater than 70° about the vertical direction, and an auxiliary winding means positioned so as to extend an angle within the range of about 65° to 90° about the vertical direction thereby developing a magnetic deflection force to deflect the electron beams deflected by the first deflection coil assembly and the primary winding means of the second deflection coil assembly and traveling towards any one of the four corner areas of the phosphor-coated screen regions in a direction away of the horizontal axis while minimizing the magnetic deflection force in the horizontal direction in the vicinity of the horizontal axis.

22. The deflection yoke as claimed in claim 21, wherein the primary winding means is positioned within the range of 0° to about 60° about the vertical direction.

23. A deflection yoke for a cathode ray tube having a funnel section and a neck section, said deflection yoke being mounted on the cathode ray tube at a location corresponding to the boundary between the funnel and neck sections, which deflection yoke comprises:

a generally tubular core;

a first deflection coil assembly including a pair of first deflection coils wound on the core and arranged in symmetrical relationship with each other with respect to the longitudinal axis of the core, said first deflection coil assembly being operable to deflect electron beams, traveling from an electron gun assembly towards a phosphor-coated screen region, in a horizontal direction;

a second deflection coil assembly generally toroidally wound on the core and operable to deflect the electron beams in a vertical direction; and a magnetizing means for producing a magnetic field for correcting a distortion occurring in the vertical direction without inviting a distortion in the horizontal direction in the vicinity of a horizontal axis perpendicular to the longitudinal axis of the tubular core.

* * * * *